US007538498B2

(12) United States Patent
Hur et al.

(10) Patent No.: US 7,538,498 B2
(45) Date of Patent: May 26, 2009

(54) DRIVING CIRCUIT OF SURFACE LIGHT SOURCE AND METHOD OF DRIVING THE SAME

(75) Inventors: Jeong Wook Hur, Cheonan-si (KR); Hwan Woong Lee, Cheonan-si (KR)

(73) Assignee: LG Electronics Inc., Seoul (KR)

( * ) Notice: Subject to any disclaimer, the term of this patent is extended or adjusted under 35 U.S.C. 154(b) by 47 days.

(21) Appl. No.: 11/766,909

(22) Filed: Jun. 22, 2007

(65) Prior Publication Data

US 2008/0106219 A1 May 8, 2008

(30) Foreign Application Priority Data

Nov. 8, 2006 (KR) ..... 10-2006-0109924

(51) Int. Cl.
*H05B 37/02* (2006.01)

(52) U.S. Cl. ..... 315/308; 315/149; 315/247; 315/309

(58) Field of Classification Search ..... 315/149–151, 315/156, 158, 291, 307–309; 345/102
See application file for complete search history.

(56) References Cited

U.S. PATENT DOCUMENTS 5,414,325 A * 5/1995 Allison ..... 315/158
5,698,952 A * 12/1997 Stebbins ..... 315/307
2004/0124788 A1* 7/2004 Ohmori ..... 315/291
2005/0088102 A1* 4/2005 Ferguson et al. ..... 315/149
2006/0255751 A1* 11/2006 Chitta et al. ..... 315/309
2008/0001555 A1 1/2008 Lu et al.

FOREIGN PATENT DOCUMENTS

| | | |
|---|---|---|
| EP | 0 632 679 | 1/1995 |
| JP | 03171596 | 7/1991 |
| KR | 1020020017358 | 3/2002 |
| KR | 1020050078312 | 8/2005 |

* cited by examiner

*Primary Examiner*—David Hung Vu
*Assistant Examiner*—Tung X Le
(74) *Attorney, Agent, or Firm*—Ked & Associates LLP

(57) ABSTRACT

A driving circuit of a surface light source and a method of driving the same are disclosed, which is suitable for decreasing the luminance-stabilization period of time and improving the low-temperature starting properties by optimizing a starting voltage and current, the driving circuit comprising an inverter controller which feedbacks a current supplied to the surface light source, and compares the feedback current to a preset reference value, to control the current supplied to the surface light source; a temperature sensor which senses an operation temperature of the surface light source; and a driving-condition determining controller which determines operation modes of the surface light source on the basis of the temperature sensed in the temperature sensor, and varies the feedback current inputted to the inverter controller according to the operation modes of the surface light source.

19 Claims, 10 Drawing Sheets

DRIVING CIRCUIT OF SURFACE LIGHT SOURCE AND METHOD OF DRIVING THE SAME

This application claims the benefit of Korean Patent Application No.10-2006-0109924 filed on Nov. 8, 2006, which is hereby incorporated by reference as if fully set forth herein.

BACKGROUND OF THE INVENTION

1. Field of the Invention

The present invention relates to a driving circuit of a surface light source which is suitable for decreasing the luminance-stabilization period of time and improving the low-temperature starting properties by optimizing a starting voltage and current, and a method of driving the same.

2. Discussion of the Related Art

With the recent development in many kinds of light source, the wide application of the light sources has been accelerated in various fields, for example, illuminating fields, information industrial fields, and image-displaying industrial fields.

The light source is largely classified into a one-dimensional light source including an optical distribution formed in shape of a dot; a two-dimensional light source including an optical distribution formed in shape of a line; and a three-dimensional light source including an optical distribution formed in shape of a surface.

A typical example of the one-dimensional light source corresponds to a light-emitting diode (LED). Also, typical examples of the two-dimensional light source correspond to a cold cathode fluorescent lamp (CCFL) and an external electrode fluorescent lamp (EEFL), and a typical example of the three-dimensional light source corresponds to a flat fluorescent lamp (FFL).

A liquid crystal display (LCD) device necessarily requires an additional backlight since the LCD device is not a self-emission device. For a light source included in the backlight of the LCD device, it is necessary to emit the uniform light in a large-sized area thereof, and to lower the power consumption.

In order to apply the one-dimensional and two-dimensional light sources to the backlight of the LCD device, the light source additionally needs a light-guiding plate (LGP), and optical members including a diffusion member and a prism sheet. Thus, the LCD device using the backlight of the one-dimensional or two-dimensional light source, for example, CCFL or LED, has increased in its volume and weight due to the optical members.

To overcome these problems, a three-dimensional surface light source having a flat type has been newly developed for the backlight of the LCD device. The surface light source may be fabricated with a plurality of discharge sections by forming a glass substrate through the use of a mold or by providing a plurality of glass or ceramic walls between two glass substrates.

The former heats the moldable glass substrate at a predetermined temperature, and then processes the moldable glass substrate by the mold, to thereby form the plurality of discharge sections which are separated from one another by the walls, and are also connected to one another. The processed glass substrate is bonded to another glass substrate by a sealing frit, thereby forming the plurality of discharge sections between the two glass substrates.

The latter forms the plurality of walls using the glass or ceramic material on the glass substrate, and then bonds the glass substrate including the plurality of walls to another glass substrate, thereby forming the plurality of discharge sections between the two glass substrates.

Typically, the FFL of the surface light source uses Hg gas. In comparison to the linear type lamp such as the CCFL or EEFL, the FFL has the larger lamp area and the more channels. Thus, if using the normal driving current and voltage after turning on the FFL, it has the increased time period to stabilize the luminance as compared with that of the related art lamp.

Hereinafter, a related art light source will be explained with the focus on the luminance properties and the low-temperature starting properties.

FIG. 1 is a graph of comparing the luminance-stabilization properties of the two-dimensional light source such as EEFL to the luminance-stabilization properties of the three-dimensional light source such as FFL. FIGS. 2A and 2B are photographs of illustrating the incomplete lighting and the gather of channels on the low-temperature starting and driving mode.

In FIG. 1, (a) illustrates the luminance-stabilization properties of the EEFL, and (b) illustrates the luminance-stabilization properties of the FFL.

Referring to FIG. 1, after starting the EEFL, the EEFL requires the time period of about 5 minutes and 50 seconds to stabilize the luminance thereof. In the meantime, after starting the FFL, the FFL requires the time period of about 18 minutes and 40 seconds to stabilize the luminance thereof. That is, the time period to stabilize the luminance of the FFL is three times as long as the time period to stabilize the luminance of the EEFL. Unless the time period to stabilize the luminance of the FFL becomes shorter, it is difficult to apply the FFL to the backlight of the LCD device.

If the FFL using Hg gas is operated in the low-temperature surroundings, it spends a long time to activate Hg gas. Also, since the flat fluorescent lamp has a large-sized cross section and also includes a plurality of channels, there is high possibility of ununiform discharge.

If the proper voltage and current are not applied to the driving circuit on the low-temperature starting and driving, the incomplete light may occur as shown in FIG. 2A, and the channels may gather to one direction as shown in FIG. 2B. If a winding ratio is increased in primary and secondary windings of a transformer to supply the proper voltage and current (raising the voltage and current), the efficiency of driving circuit is deteriorated.

If the voltage and current are increased to stabilize the initial luminance of driving circuit, it is possible to stabilize the luminance of driving circuit. In this case, unless the voltage and current are slowly decreased by preset periods of time, the flickering and the rapid decrease of luminance may occur.

FIG. 3 is a graph of illustrating the luminance properties if high voltage and current are applied to a flat fluorescent lamp so as to stabilize the luminance. As shown in FIG. 3, if the voltage and current are increased for the initial stabilization of luminance, the luminance is stabilized. However, if maintaining the voltage and current applied to the flat fluorescent lamp, the flickering and the rapid decrease of luminance occur as shown in (A) of FIG. 3.

SUMMARY OF THE INVENTION

Accordingly, the present invention is directed to a driving circuit of a surface light source and a method of driving the same that substantially obviates one or more problems due to limitations and disadvantages of the related art.

An object of the present invention is to provide a driving circuit of a surface light source which is suitable for decreasing the luminance-stabilization period of time and improving the low-temperature starting properties by optimizing a starting voltage and current, and a method of driving the same.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a driving circuit of a surface light source comprises an inverter controller which feedbacks a current supplied to the surface light source, and compares the feedback current to a preset reference value, to control the current supplied to the surface light source; a temperature sensor which senses an operation temperature of the surface light source; and a driving-condition determining controller which determines operation modes of the surface light source on the basis of the temperature sensed in the temperature sensor, and varies the feedback current inputted to the inverter controller according to the operation modes of the surface light source.

In another aspect, a driving circuit of a surface light source comprises an inverter controller which feedbacks a current supplied to the surface light source, and compares the feedback current to a preset reference value, to control the current supplied to the surface light source; a temperature sensor which senses an operation temperature of the surface light source; and a driving-condition determining controller which determines operation modes of the surface light source on the basis of the temperature sensed in the temperature sensor, varies the feedback current inputted to the inverter controller according to the operation modes of the surface light source, and outputs on/off signals to control an operation time period of the inverter controller by varying a duty ratio depending on the varied feedback current.

At this time, the driving circuit further includes a divider which divides the feedback current, and outputs the divided current to the inverter controller; and at least two current breakers which limit the level of current divided by the divider and applied to the inverter controller under control of the driving-condition determining controller.

In another aspect, a method of driving a surface light source including an inverter controller to control a current applied to the surface light source, and a driving-condition determining controller to determine operation modes of the surface light source on the basis of an operation temperature, and to vary a current outputted to the inverter controller, comprises sensing the operation temperature of the surface light source; determining the operation modes of the surface light source according to the sensed operation temperature; and outputting an output current of the inverter controller based on the determined operation mode.

At this time, determining the operation modes includes a striking mode to apply a high current to the surface light source when the operation temperature of the surface light source is in a low-temperature range below a room temperature; a warm-up mode to apply a current, which is lower than that for the striking mode, to the surface light source when the operation temperature of the surface light source is in the room temperature range, for the stabilization of luminance; and a normal mode to drive the surface light source based on a feedback current of the surface light source when the operation temperature of the surface light source is above the room temperature range.

Also, a duty ratio is relatively low if the current applied to the surface light source is high, and the duty ratio is relatively high if the current applied to the surface light source is low, to lower the power consumption.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Hereinafter, a driving circuit of a surface light source according to the present invention and a driving method thereof will be described with reference to the accompanying drawings.

Figure 1:
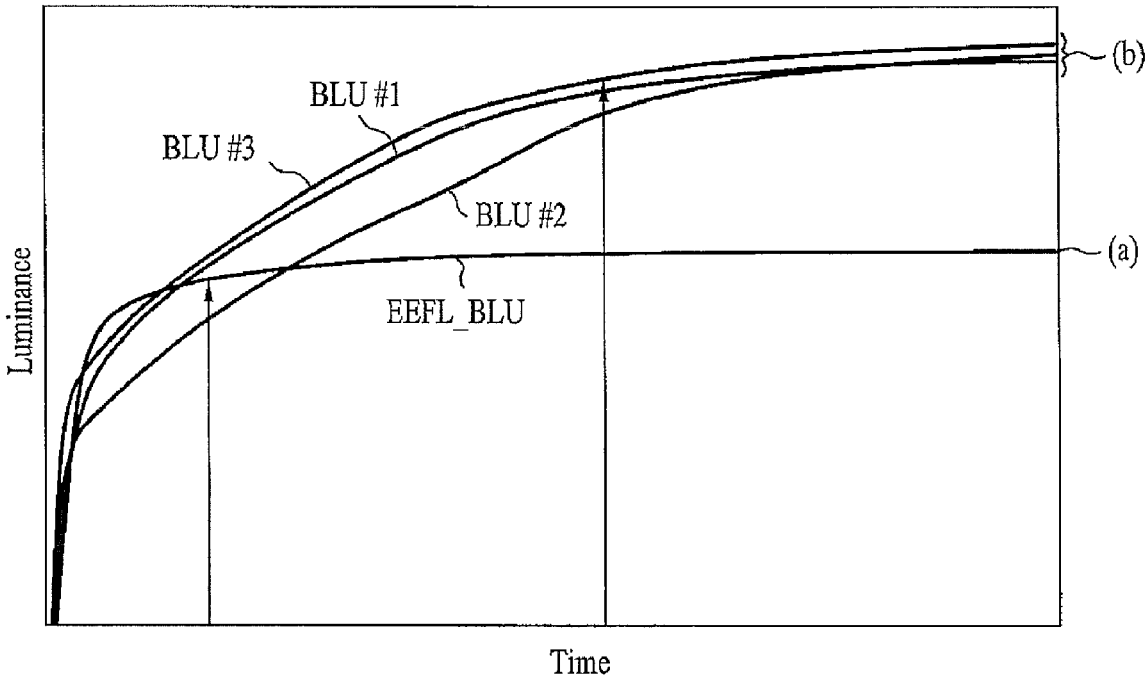
FIG. 1 Related Art
FIG. 1 is a graph of illustrating the luminance-stabilization properties in relation to a flat fluorescent lamp (FFL) and an external-electrode fluorescent lamp (EEFL) according to the related art.
Figure 2A:
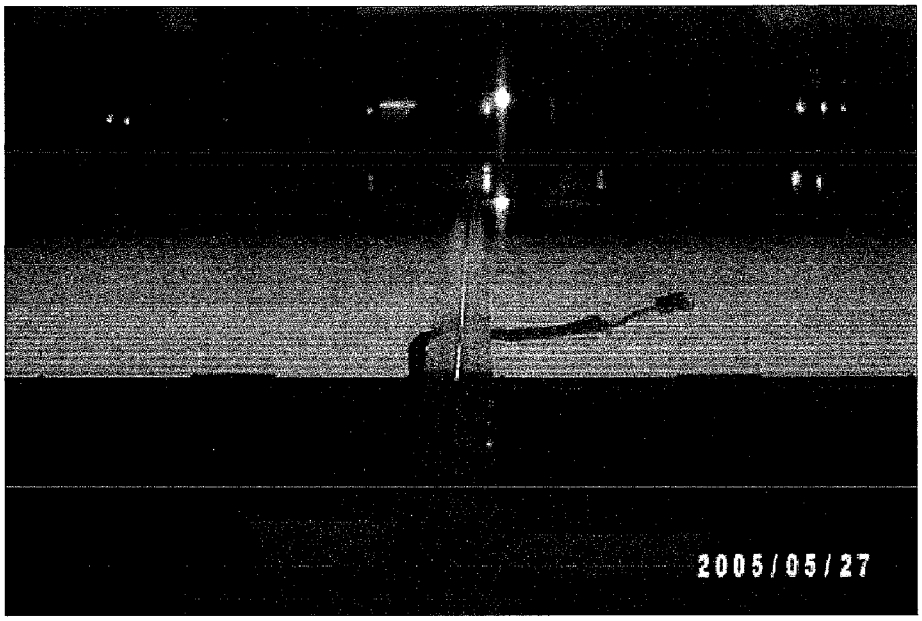
FIG. 2A Related Art
FIGS. 2A and 2B are photographs of illustrating the incomplete lighting and the gather of channels on a low-temperature starting and driving mode.
Figure 2B:
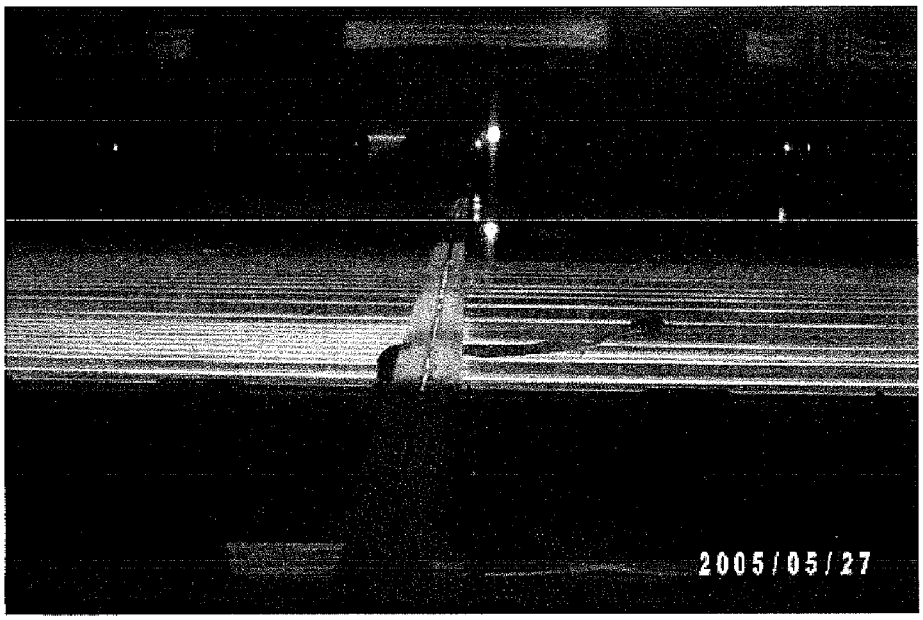
FIG. 2B Related Art
Figure 3:
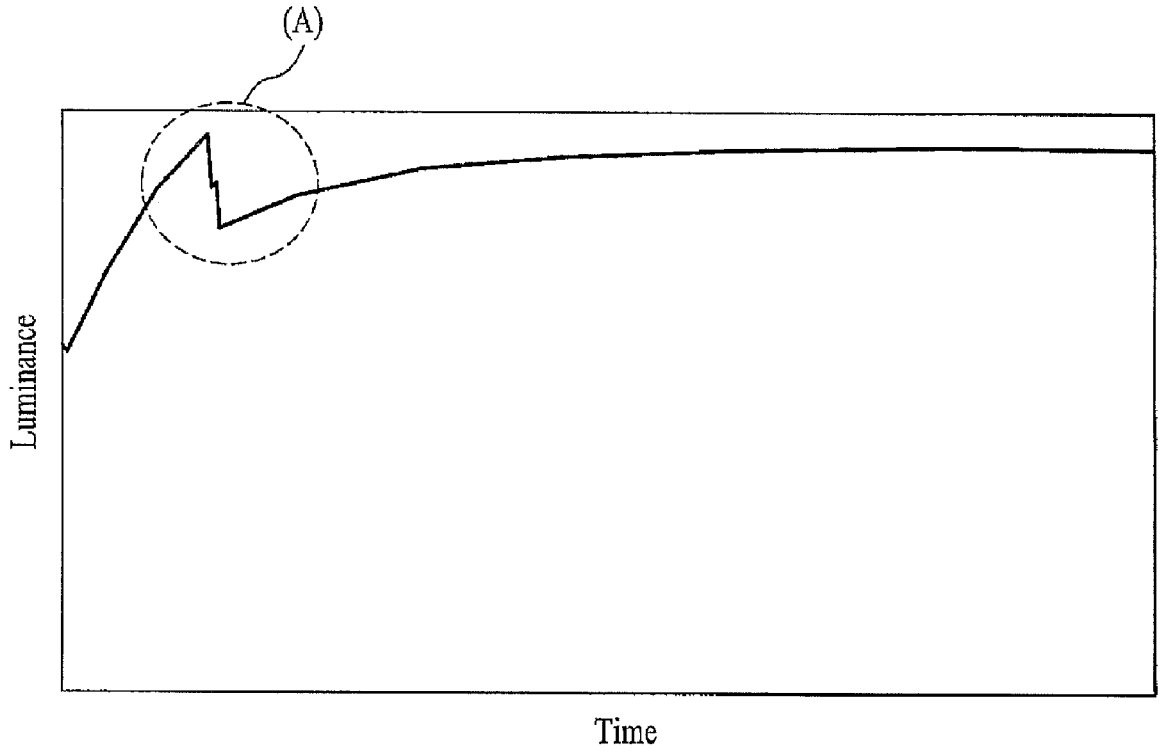
FIG. 3 Related Art
FIG. 3 is a graph of illustrating the luminance properties if high voltage and current are applied to a flat fluorescent lamp so as to stabilize the luminance.
Figure 4:
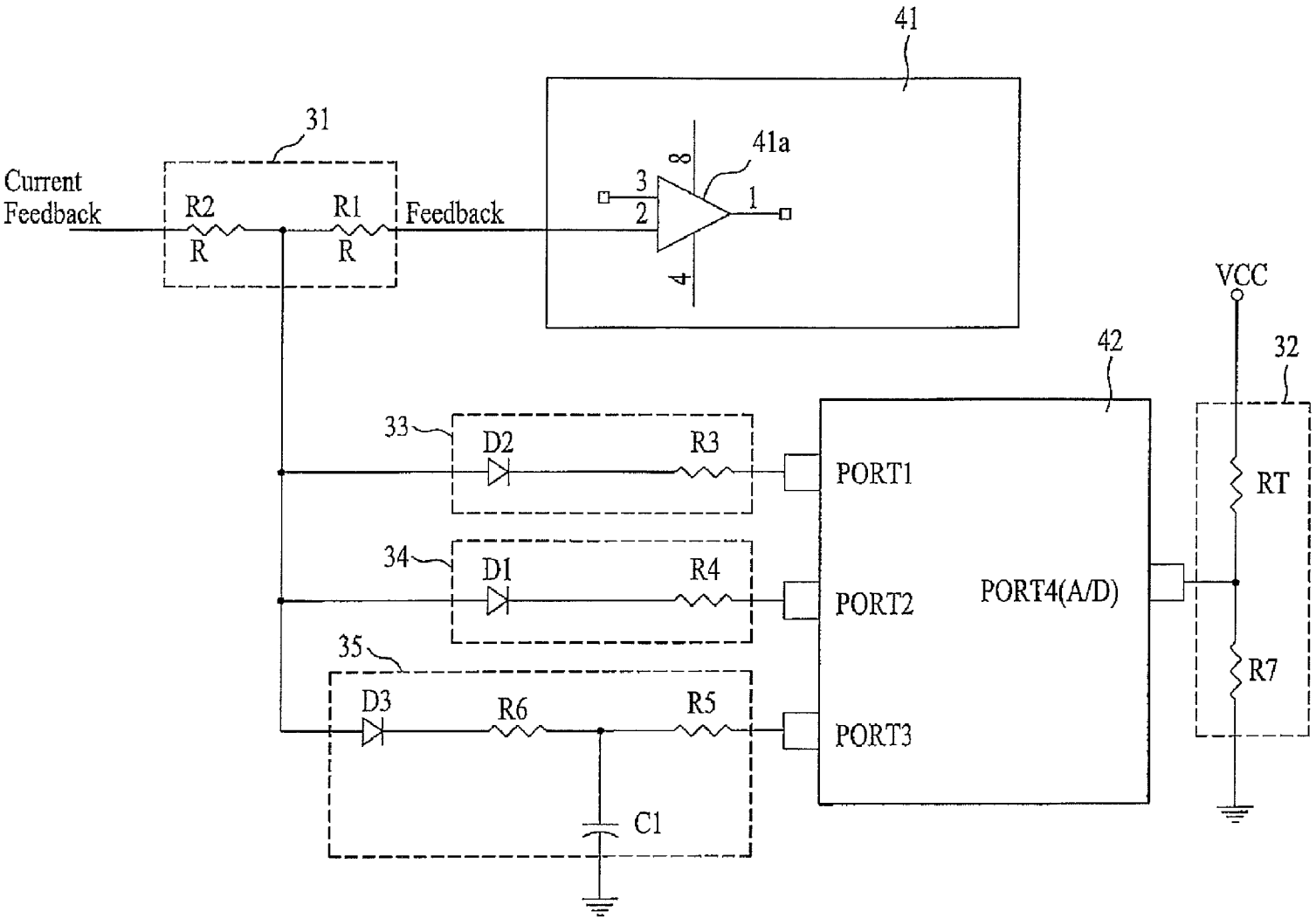
FIG. 4 is a schematic view of illustrating a driving circuit of surface light source according to the first embodiment of the present invention.

FIG. 4 is a schematic view of illustrating a driving circuit of a surface light source according to the first embodiment of the present invention.

As shown in FIG. 4, the driving circuit of the surface light source according to the first embodiment of the present invention is comprised of a divider 31; an inverter controller 41; a temperature sensor 32; a first current breaker 35; a second current breaker 34; a third current breaker 35; and a driving-condition determining controller 42. At this time, the divider 31 includes resistors (R1, R2) to divide a current supplied to the surface light source by feedback. Then, the inverter controller 41 feedbacks the current supplied to the surface light source through the divider 31; compares the feedback current with a reference current value to thereby control the current applied to the surface light source. Also, the temperature sensor 32 includes a temperature sensing part (thermistor, RT) and a resistor (R7), thereby sensing the temperature in the circumference of the surface light source. The first current breaker 33 includes a diode (D2) and a resistor (R3), wherein the first current breaker 33 limits the level of current divided by the divider 31 and applied to the inverter controller 41. The second current breaker 34 includes a diode (D1) and a resistor (R4), wherein the second current breaker 34 limits the level of current divided by the divider 31 and applied to the inverter controller 41. The third current breaker 35 includes a diode (D3), resistors (R5, R6), and a capacitor (C1), wherein the third current breaker 35 limits the level of current divided by the divider 31 and applied to the inverter controller 41. Then, the driving-condition determining controller 42 determines the driving conditions of a striking mode for the low-temperature driving, a warm-up mode for the stabilization of luminance, and a normal mode for the normal-state driving on the basis of the circumferential temperature sensed by the temperature sensor 32; and forcibly controls the feedback current applied to the inverter controller 41 by controlling the first, second and third current breakers 33, 34 and 35.

The first, second and third current breakers 33, 34 and 35 are connected to a connection node of the first and second feedback resistors (R1, R2) of the divider 31 in common; and are connected to first, second and third ports (port1, port2 and port3) included in the driving-condition determining controller 42. That is, the first current breaker 33 is connected to the first port (port1) of the driving-condition determining controller 42; the second current breaker 34 is connected to the second part (port2) of the driving-condition determining controller 42; and the third current breaker 35 is connected to the third port (port3) of the driving-condition determining controller 42.

In FIG. 4, the respective resistors (R3, R4, R5, R6) of the first, second and third current breakers 33, 34 and 35 have the different resistance values. For the design of FIG. 4, the resistance value on the resistor (R3) of the first current breaker 33 is lower than the resistance value on the resistor (R4) of the second current breaker 34; and the resistance value on the resistors (R5+R6) of the third current breaker 35 is lower than the resistance value on the resistor (R4) of the second current breaker 34. The third current breaker 35 is comprised of the capacitor (C1), whereby the third current breaker 35 prevents the rapid change of the feedback current applied to the inverter controller 41 under control of the driving-condition determining controller 42.

FIG. 4 shows the three current breakers 33, 34 and 35. However, it is not limited to the three, and the four or more current breakers may be provided.

To sense the operation temperature of the surface light source, the temperature sensor 32 includes the temperature sensing part (thermistor, RT) and the resistor (R7) connected between a power source voltage terminal (VCC) and a grounded terminal in series. Thus, the connection node of the temperature sensing part (thermistor, RT) and the resistor (R7) is connected to the fourth port (port4) of the driving-condition determining controller 42.

At this time, the inverter controller 41 includes a differential amplifier (comparator) 41*a* which amplifies the difference between the feedback current inputted to an inversion terminal (−) and the reference current inputted to a non-inversion terminal (+). If a comparator or A/D converter is formed in the driving-condition determining controller 42, the temperature sensor 32 may use various sensors without providing an additional external circuit.

If using only an auxiliary starting circuit of the inverter controller 41, it is operated within the preset range of current owing to the limitation of feedback. In order to solve this problem, there is provided the driving-condition determining controller 42. The driving-condition determining controller 42 raises the current and voltage appropriately, whereby the driving-condition determining controller 42 enables the feedback depending on the voltage change in current increased by the change of input voltage.

An operation of the driving circuit of the surface light source according to the first embodiment of the present invention will be explained as follows.

Figure 5:
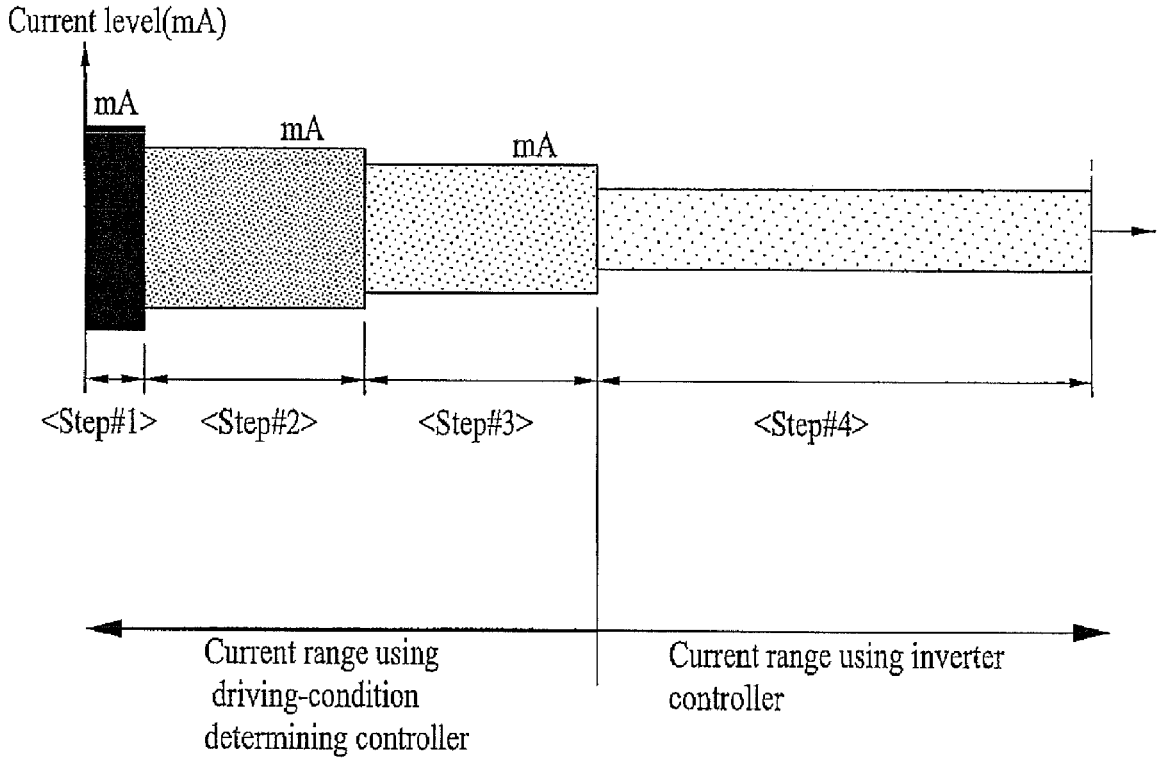
FIG. 5 is a graph of illustrating current levels supplied to a surface light source according to the first embodiment of the present invention.
Figure 6:
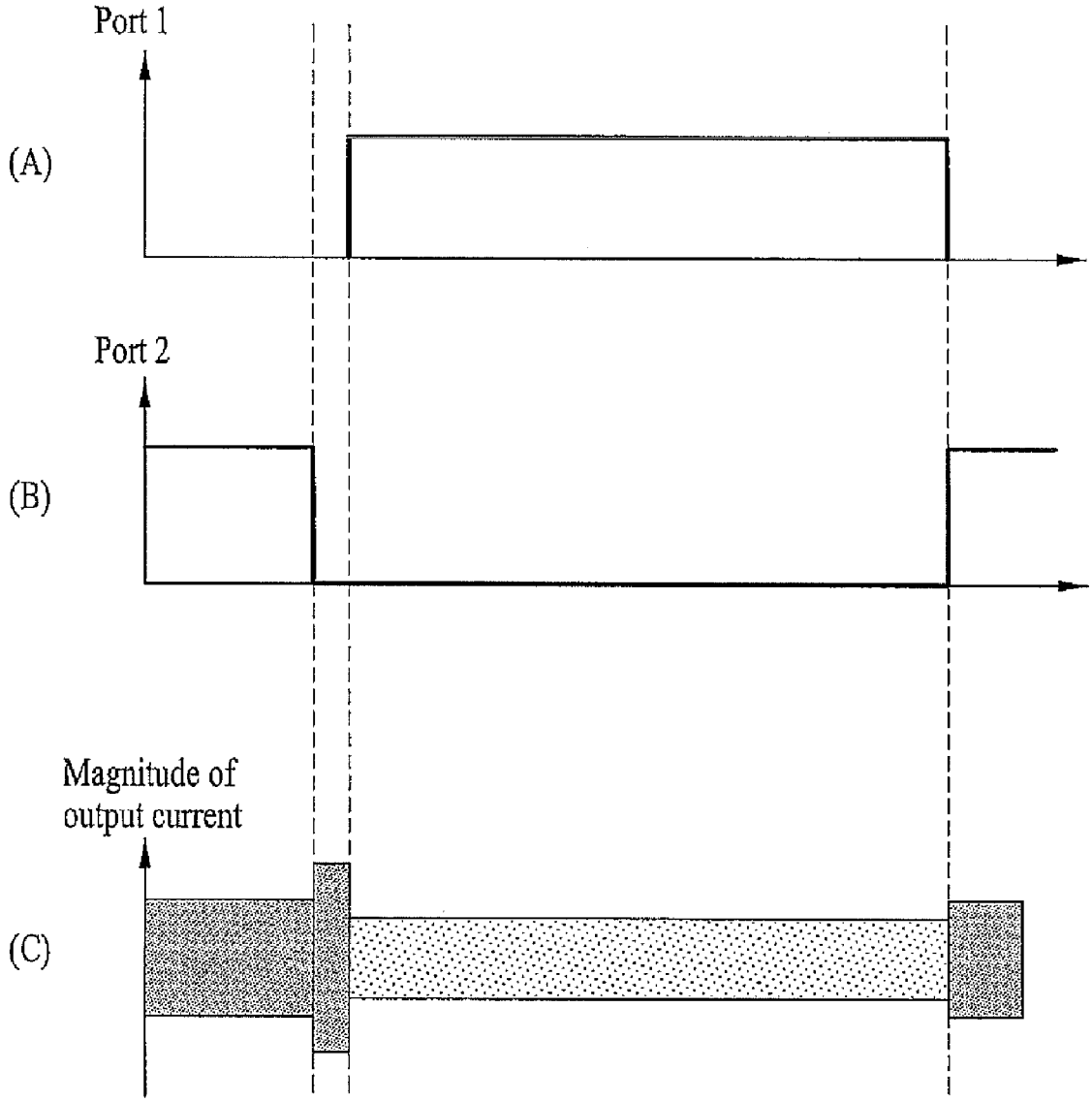
FIG. 6 is a graph of illustrating output currents of driving-condition determining controller according to the first embodiment of the present invention.
Figure 7:
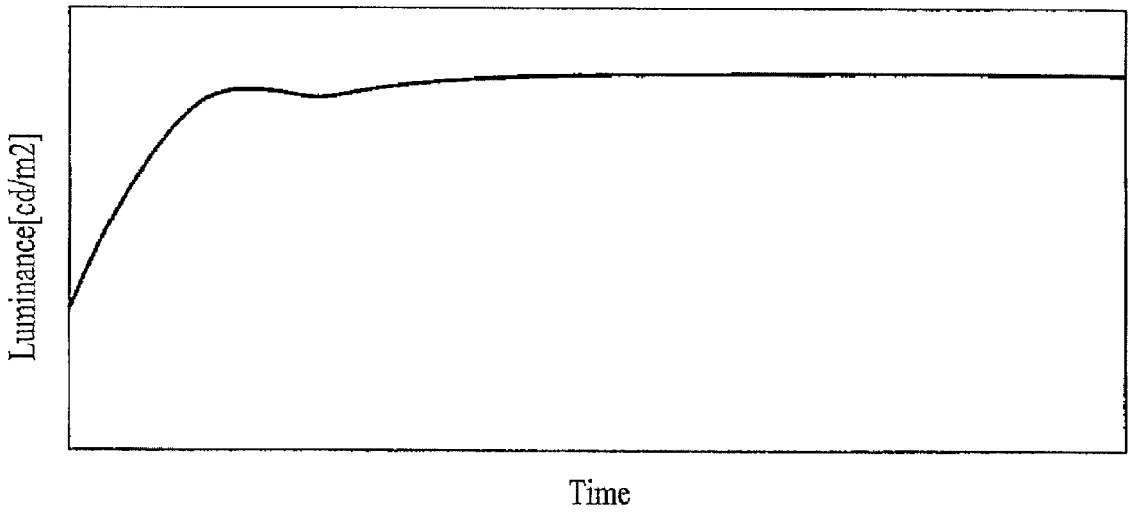
FIG. 7 is a graph of illustrating the luminance stabilization based on an inverter driving circuit according to the first embodiment of the present invention.
Figure 8:
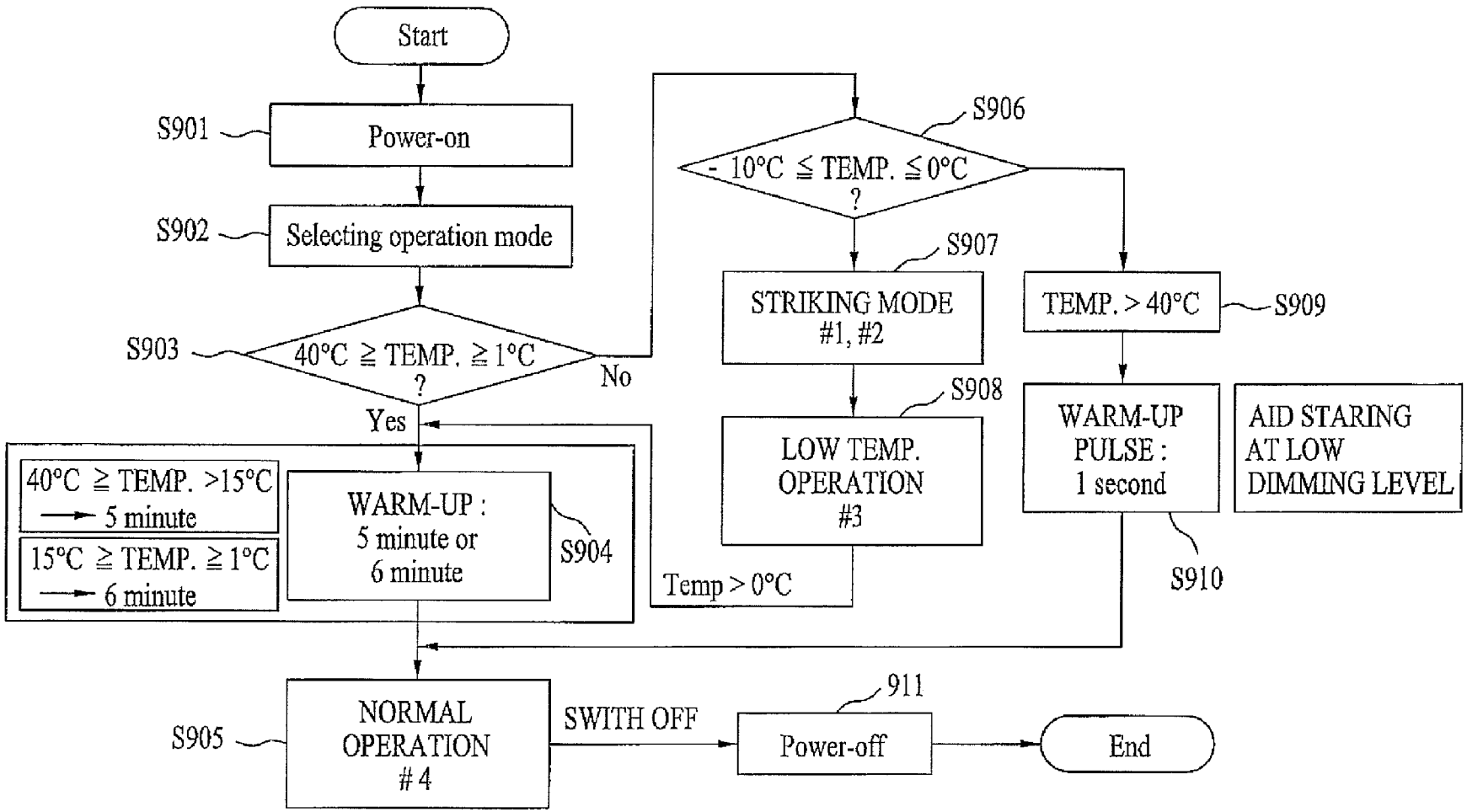
FIG. 8 is a flow chart of illustrating a controlling method for a driving circuit of a surface light source according to the first embodiment of the present invention.

FIG. 5 is a graph of illustrating current levels supplied to the surface light source according to the first embodiment of the present invention. FIG. 6 is a graph of illustrating the output current properties of the driving-condition determining controller according to the first embodiment of the present invention. FIG. 7 is a graph of illustrating the luminance stabilization properties in the driving circuit of the surface light source according to the first embodiment of the present invention. FIG. 8 is a flow chart of illustrating the control process in the driving circuit of the surface light source according to the first embodiment of the present invention.

As the voltage is applied to the driving circuit, the driving-condition determining controller 42 senses the operation temperature of the surface light source by the temperature sensor 32 connected to the fourth port (port4). That is, the driving-condition determining controller 42 determines the driving conditions of the striking mode for the low-temperature driving, the warm-up mode for the stabilization of luminance, and the normal mode for the normal-state driving on the basis of the sensed operation temperature of the surface light source.

As explained above, if the flat fluorescent lamp (FFL) using Hg gas is operated in the low-temperature surroundings, it spends a long time to activate Hg gas. Also, since the flat fluorescent lamp has a large-sized cross section and also includes a plurality of channels, there is high possibility of ununiform discharge. In this respect, a relatively high voltage is applied to the driving circuit when the driving circuit is operated in the low-temperature surroundings.

For the stabilization of initial luminance, the optimized current is applied for a preset period of time, thereby securing the initial stabilization time. After the preset period of time, the lamp current is slowly decreased by fixed intervals to thereby prevent the flickering and the unstable luminance.

The striking mode is operated when the operation temperature of the surface light source, which is sensed by the temperature sensor (RT) at the first sensing time after applying the voltage to the inverter, is in the low-temperature range (−10° C.~0° C.). The warm-up mode is operated when the operation temperature of the surface light source is between 1° C. and 40° C. (and more particularly, 1° C.<the operation temperature≦40° C.). The normal mode is operated in the normal state after completing the warm-up mode.

A method of controlling the current amount on the respective conditions (except the normal mode) by switching the first, second and third ports (port1, port2 and port3) on the basis of the determination conditions of the driving-condition determining controller 42 will be explained as follows.

Referring to FIG. 5, the driving-condition determining controller 42 can control the current amount in relation to the conditions by various ranges of (step#1), (step#2) and (step#3). Thus, the driving-condition determining controller 42 is operated not only by one current range (step#4) but also by the various ranges, to thereby enable the luminance stabilization and the supply of appropriate current on the low-temperature driving. That is, if the low signal is selectively outputted to the first, second and third ports (port1, por2 and port3), the driving-condition determining controller 42 controls the inverter controller 41 as the striking mode and the warm-up mode.

This will be explained in detail.

First, if the low signal is outputted to the first, second and third ports of the driving-condition determining controller 42, the respective diodes (D1, D2, D3) of the first, second and third current breakers 33, 34 and 35 are operated in the forward direction, whereby the current path is formed in the respective current breakers 33, 34 and 35. Accordingly, the feedback current applied to the inversion terminal (−) of the differential amplifier 41*a* provided in the inverter controller 41 is decreased to the minimum. In this case, the differential amplifier 41*a* amplifies and outputs the highest current, as shown in (step#1) of FIG. 5.

As the high signal is outputted to the first port of the driving-condition determining controller 42, and the low signal is outputted to the second and third ports, the current path is formed not in the first current breaker 33 but in the second and third current breakers 34 and 35. Thus, the feedback current applied to the inversion terminal (−) of the differential amplifier 41*a* provided in the inverter controller 41 is increased more than the feedback current applied when the low signal is outputted to the first, second and third ports of the driving-condition determining controller 42. In this case, the differential amplifier 41*a* amplifies and outputs the current having the level shown in (step#2) of FIG. 5.

If the high signal is outputted to the first and second ports of the driving-condition determining controller 42, and the low signal is outputted to the third port, the current path is formed not in the first and second current breakers 33 and 34 but in the third current breaker 35. Thus, the feedback current applied to the inversion terminal (−) of the differential amplifier 41*a* provided in the inverter controller 41 is increased more than the feedback current applied when the high signal is outputted to the first port and the low signal is outputted to the second and third ports. In this case, the differential amplifier 41*a* amplifies and outputs the current having the level shown in (step#3) of FIG. 5.

If the high signal is outputted to the first, second and third ports of the driving-condition determining controller 42, the first, second and third current breakers 33, 34 and 35 have no current path formed therein. Thus, the feedback current applied to the inversion terminal (−) of the differential amplifier 41*a* provided in the inverter controller 41 becomes the maximum without regard to the control of the driving-condition determining controller 42. In this case, the differential amplifier 41*a* amplifies and outputs the current having the level shown in (step#4) of FIG. 5.

At this time, the potential of feedback current inputted to the inverter controller 41 is controlled smoothly without the rapid change thereof by the third current breaker 35.

This will be explained with reference to FIG. 6.

Referring to (C) of FIG. 6, the magnitude of output current corresponds to the magnitude of current outputted from the differential amplifier 41*a* of the inverter controller 41. In this method, the driving-condition determining controller 42 selectively outputs the low signal to the first, second and third ports, to thereby drive the surface light source on the respective modes.

That is, the striking mode is operated by (step#1) and (step#2) of FIG. 5 when the low signal is outputted to the first, second and third ports, or when the high signal is outputted to the first port and the low signal is outputted to the second and third ports. The warm-up mode is operated by (step#3) of FIG. 5 when the high signal is outputted to the first and second ports and the low signal is outputted to the third port. The normal mode is operated by (step#4) of FIG. 5 when the high signal is outputted to the first, second and third ports.

The feedback current applied to the inversion terminal of the differential amplifier 41*a* of the inverter controller 41 is controlled by the driving-condition determining controller 42; and the current applied to the surface light source is controlled depending on the output signal of the differential amplifier 41*a*. As shown in FIG. 7, on the low-temperature driving for the preset period of time, the current and voltage are linearly decreased so as to stabilize the luminance.

A driving method of the surface light source according to the first embodiment of the present invention will be explained with reference to FIG. 8.

If the surface light source is powered-on (S901), the driving-condition determining controller 42 senses the temperature of the surface light source by the temperature sensor 32, to thereby select the operation mode. Thus, it is determined whether the operation temperature of the surface light source is in the room temperature (S903). For the first embodiment of the present invention, the room temperature is determined at the range from 1° C. to 40° C.

If the sensed temperature is in the room temperature, the warm-up mode is operated to stabilize the luminance (S904). By the subdivision of the operation temperature, the warm-up mode is maintained for 5 minutes in case of 15° C.<the operation temperature≦40° C., and the warm-up mode is maintained for 6 minutes in case of 1° C.≦the operation temperature≦15° C. That is, the driving-condition determining controller 42 outputs the high signal to the first and second ports, and outputs the low signal to the third port, whereby the current having the level corresponding to (step#3) of FIG. 5 is applied to the surface light source. In this case, the warm-up mode is maintained for 5 minutes in case of 15° C<the operation temperature≦40° C., and the warm-up mode is maintained for 6 minutes in case of 1° C.≦the operation temperature≦15° C.

In another method, if 1° C.≦the operation temperature≦15° C., the driving-condition determining controller 42 outputs the high signal to the first port, and outputs the low signal to the second and third ports, whereby the current having the level corresponding to (step#2) of FIG. 5 is applied to the surface light source. If 15° C.<the operation temperature≦40° C., the driving-condition determining controller 42 outputs the high signal to the first and second ports, and outputs the low signal to the third port, whereby the current having the level corresponding (step#3) of FIG. 5 is applied to the surface light source.

After stabilizing the luminance by the warm-up mode, the normal mode having the level corresponding (step#4) of FIG. 5 is operated (S905). That is, the driving-condition determining controller 42 outputs the high signals to the first, second and third ports, whereby the inverter controller 41 is operated with the current and voltage supplied to the surface light source by the level corresponding to (step#4) of FIG. 5 based on the feedback current without regard to the control of the driving-condition determining controller 42.

The normal mode is maintained until the power switch is turned-off (S911).

In the step (S903), if the sensed operation temperature of surface light source is not in the range of room temperature, it is determined whether the driving circuit is in the striking mode for the low-temperature starting and driving (S906).

If the sensed temperature is in the range between −10° C. and 0° C. (−10° C.<the operation temperature≦0° C.), the striking mode for the low-temperature starting is carried out (S907). The striking mode is operated by the level corresponding to (step#1) and (step#2) of FIG. 5. The striking mode requires the high current for the initial starting of the surface light source. Thus, the driving-condition determining controller 42 outputs the low signal to the first, second and third ports, whereby the maximum current (step#1 of FIG. 5) is instantaneously outputted to the inverter controller 41.

As the maximum current is applied to the surface light source, the surface light source is started. Then, the driving-condition determining controller 42 outputs the high signal to the first port, and outputs the low signal to the second and third ports, whereby the current having the level corresponding to (step#2) of FIG. 5 is applied to the surface light source. Accordingly, if the surface light source is operated in the striking mode by the current having the level corresponding to (step#2) of FIG. 5, and the operation temperature of the surface light source is above 0° C., the warm-up mode having the level corresponding to (step#3) of FIG. 5 is carried out for the stabilization of luminance (S908).

If the operation temperature of the surface light source is not in the room temperature or the low-temperature range but in the high-temperature range, for example, above 40° C. (S909), the warm-up pulse (level corresponding to step#3 of FIG. 5) is applied for 1 sec, and the normal mode having the level corresponding to (step#4) of FIG. 5 is operated.

The normal mode is carried out until the switch is turned-off.

The driving voltage for the control of operation is determined depending on the level of FIG. 5.

For the first embodiment of the present invention, the range of operation temperature may vary on the properties of the surface light source. The present invention is not limited to the above-explained preferred embodiment. For example, one inverter structure may be individually set by each surface light source; the low-temperature range is set between −20° C. and 0° C.; the room temperature range is set between 1° C. and 10° C., between 11° C. and 38° C., or between 11° C. and 39° C.

In the first embodiment of the present invention, the driving-condition determining controller 42 forcibly increases the driving current of the surface light source, to thereby improve the low-temperature properties and to decrease the time period of stabilizing the luminance.

That is, the surface light source is normally driven by about 130 mA. However, the surface light source using the driving-condition determining controller 42 to decrease the luminance-stabilization time period and to improve the low-temperature starting properties is operated by about 200 mA.

However, manufactures using the surface light source, for example, a liquid crystal display (LCD) device has the limitation on power consumption (W). Accordingly, if driving the surface light source according to the first embodiment of the present invention, the surface light source can not be applied to the LCD device.

To overcome the problem in relation with the limitation on power consumption (W), a driving circuit of a surface light source according to the second embodiment of the present invention and a driving method thereof are proposed. That is, the driving circuit of the surface light source according to the second embodiment of the present invention maintains the instantaneous current and decreases the time period of supplying the current, thereby decreasing the power consumption.

Figure 9:
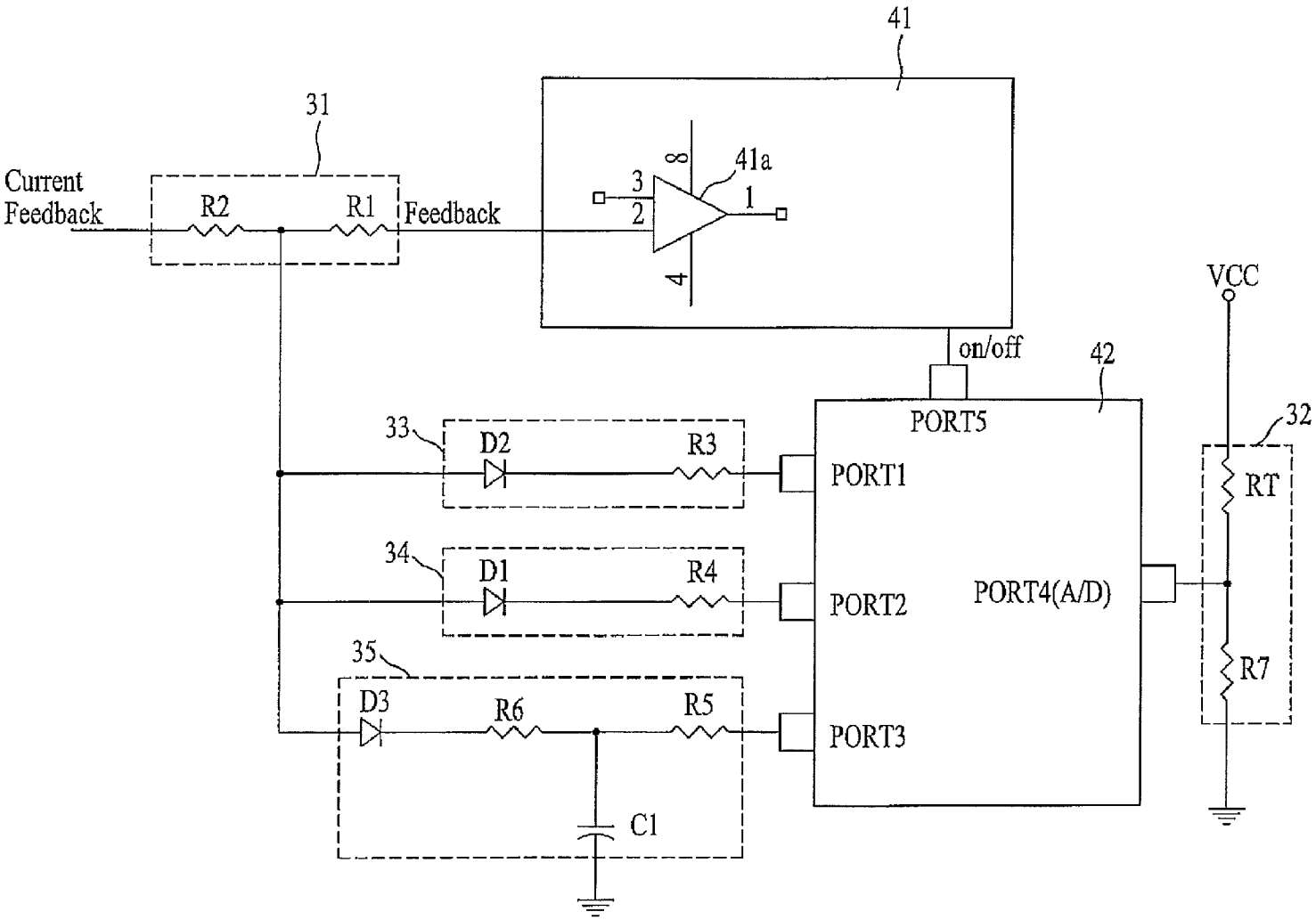
FIG. 9 is a schematic view of illustrating a driving circuit of a surface light source according to the second embodiment of the present invention.

FIG. 9 is a schematic view of illustrating a driving circuit of a surface light source according to the second embodiment of the present invention.

As shown in FIG. 9, the driving circuit of the surface light source according to the second embodiment of the present invention is comprised of a divider 31; an inverter controller 41; a temperature sensor 32; a first current breaker 33; a second current breaker 34; a third current breaker 35; and a driving-condition determining controller 42. At this time, the divider 31 includes resistors (R1, R2) to divide a current supplied to the surface light source by feedback. Then, the inverter controller 41 feedbacks the current supplied to the surface light source through the divider 31; and generates a driving pulse to control the current applied to the surface light source by comparing the feedback current with a reference current value. Also, the temperature sensor 32 includes a temperature sensing part (thermistor, RT) and a resistor (R7), thereby sensing the temperature in the circumference of the surface light source. The first current breaker 33 includes a diode (D2) and a resistor (R3), wherein the first current breaker 33 limits the level of current divided by the divider 31 and applied to the inverter controller 41. The second current breaker 34 includes a diode (D1) and a resistor (R4), wherein the second current breaker 34 limits the level of current divided by the divider 31 and applied to the inverter controller 41. The third current breaker 35 includes a diode (D3), resistors (R5, R6), and a capacitor (C1), wherein the third current breaker 35 limits the level of current divided by the divider 31 and applied to the inverter controller 41. Then, the driving-condition determining controller 42 determines the driving conditions of a striking mode for the low-temperature driving, a warm-up mode for the stabilization of luminance, and a normal mode for the normal-state driving on the basis of the circumferential temperature sensed by the temperature sensor 32; forcibly controls the feedback current applied to the inverter controller 41 by controlling the first, second and third current breakers 33, 34 and 35; and decreases the power consumption (W) by controlling a duty ratio of current applied on the striking mode or the warm-up mode.

Except the driving-condition determining controller 42, the above-mentioned elements provided in the surface light source according to the second embodiment of the present invention are identical in structure and function to those provided in the surface light source according to the first embodiment of the present invention.

When driving the striking mode or the warm-up mode to decrease the time period of stabilizing the luminance and to improve the low-temperature starting properties, the high current is forcibly applied to the surface light source, whereby the power consumption (W) is increased. In case of the driving-condition determining controller 42 according to the second embodiment of the present invention, even though it is supplied with the high current on the striking mode or the warm-up mode, the time period of applying the current is decreased to lower the power consumption (W). Accordingly, the driving-condition determining controller 42 according to the second embodiment of the present invention includes a fifth port which outputs on/off signals to control the operation time period (duty ratio) of the inverter controller 41.

A driving method of the surface light source according to the second embodiment of the present invention is explained as follows.

The driving method relating the striking mode, the warm-up mode and the normal mode in the surface light source according to the second embodiment of the present invention is the same as that of the first embodiment of the present invention shown in FIG. 8.

In order to lower the power consumption (W) on the striking or warm-up mode, the inverter controller 41 is turned-on/off, to thereby control the ratio of operation time.

FIG. 10(A) to (D) illustrate output waveforms of the inverter controller according to the second embodiment of the present invention.

Figure 10:
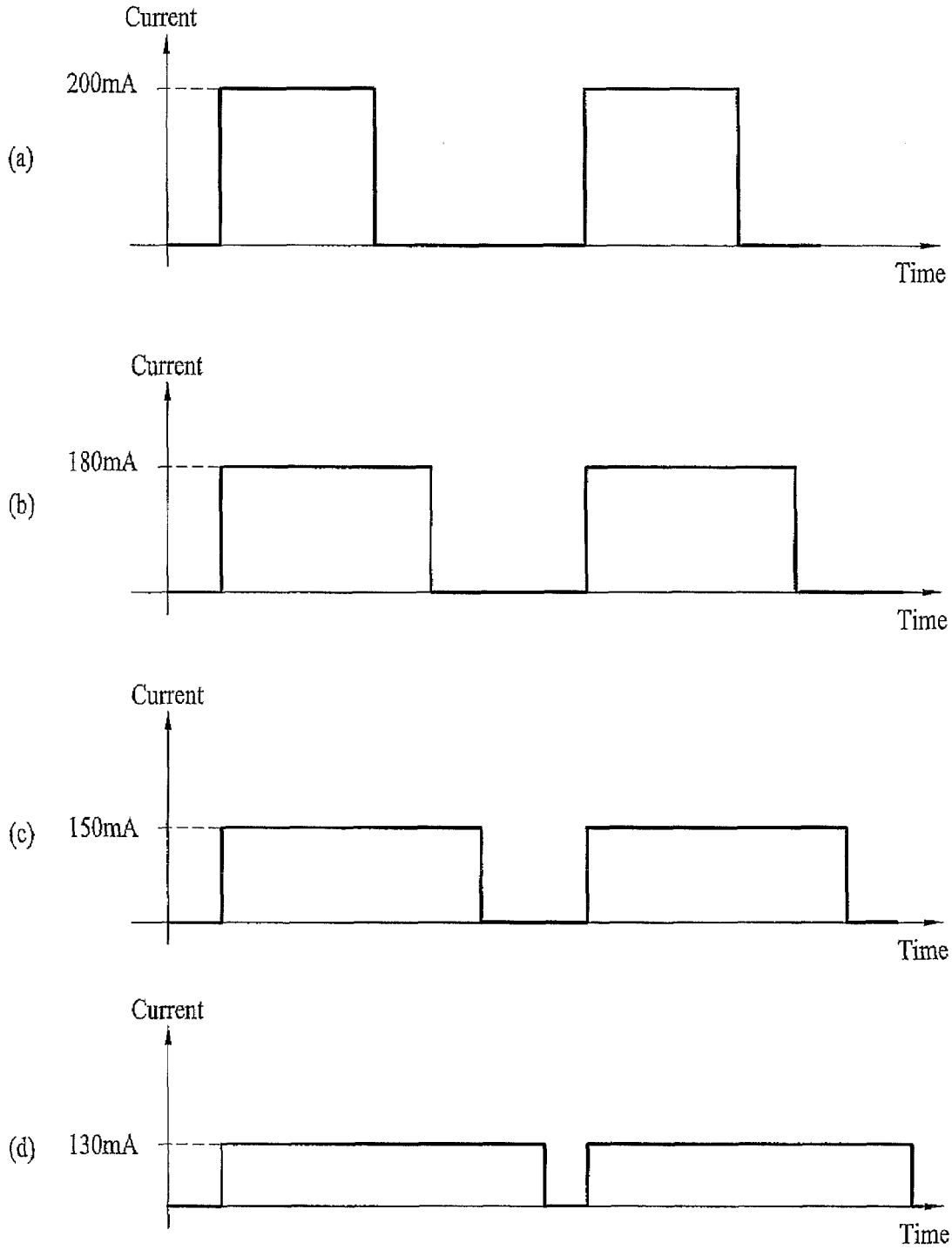
FIG. 10(A) to (D) illustrate output waveforms of an inverter controller according to the second embodiment of the present invention.

If the sensed temperature is in the range between −10° C. and 0° C. (−10° C.< the operation temperature≦0° C.), the driving mode for the low-temperature starting of the level corresponding to (step#1) of FIG. 5 is operated. Thus, the driving-condition determining controller 42 outputs the low signal to the first, second and third ports, and the fifth port outputs the on/off control signal having the duty ratio of about 44% to 55%. Accordingly, the waveform outputted from the inverter controller 41 is shown as (A) of FIG. 10, wherein (A) of FIG. 10 illustrate the exemplary embodiment of the present invention where the inverter controller 41 outputs the current of about 200 mA to the surface light source and the fifth port outputs the duty ratio of about 45% to 55%.

As starting the surface light source, the driving-condition determining controller 42 outputs the high signal to the first port, and outputs the low signal to the second and third ports, whereby the current having the level corresponding to (step#2) of FIG. 5 is applied to the surface light source and the fifth port outputs the on/off control signal having the duty ratio between 55% and 80% (55%≦the duty ratio<80%) at the same time. Accordingly, the waveform of signal outputted from the inverter controller 41 is shown as (B) of FIG. 10, wherein (B) of FIG. 10 illustrate the exemplary embodiment of the present invention where the inverter controller 41 outputs the current of about 180 mA to the surface light source and the fifth port outputs the duty ratio of about 55% to 80% (55%≦the duty ratio<80%).

When operating the warm-up mode to stabilize the luminance by the level corresponding to (step#3) of FIG. 5 at the operation temperature above 0° C., the driving-condition determining controller 42 outputs the high signal to the first and second ports, and outputs the low signal to the third port, whereby the current having the level corresponding to (step#3) of FIG. 5 is applied to the surface light source and the fifth port outputs the on/off control signal having the duty ratio between 55% and 95% (55%≦the duty ratio<95%) at the same time. Accordingly, the waveform of signal outputted from the inverter controller 41 is shown as (C) of FIG. 10, wherein (C) of FIG. 10 illustrate the exemplary embodiment of the present invention where the inverter controller 41 outputs the current of about 150 mA to the surface light source and the fifth port outputs the duty ratio of about 55% to 95% (55%≦the duty ratio<95%).

In the same method, when operating the normal mode based on (step#4) of FIG. 5, the driving-condition determining controller 42 outputs the high signal to the first, second and third ports, and the fifth port output the on/off control signal having the duty ratio of about 100%. Accordingly, the waveform of signal outputted from the inverter controller 41 is shown as (D) of FIG. 10, wherein (D) of FIG. 10 illustrate the exemplary embodiment of the present invention where the inverter controller 41 outputs the current of about 130 mA to the surface light source and the fifth port outputs the duty ratio above 95%.

For (A) to (D) of FIG. 10, the duty ratio is not limited to the above-mentioned ranges. If the current applied to the surface light source is high, the duty ratio becomes relatively low. In the meantime, if the current applied to the surface light source is low, the duty ratio becomes relatively high.

As mentioned above, the driving circuit of the surface light source according to the present invention and the method of driving the same have the following advantages.

To stabilize the luminance on the initial driving of the surface light source, the current and voltage are increased to the predetermined level, thereby shortening the time period for the stabilization of luminance.

Also, the inverter controller outputs the different ranges in relation to the operation current based on the determination of the temperature and operation conditions by outputting the various driving pulses in addition to the current range for the normal operation, to thereby improve the operation properties of the surface light source.

The operation current range of the surface light source is not fixed but varied depending on the operation modes, whereby the driving circuit of the surface light source improves in the low-temperature starting and driving properties.

Furthermore, the voltage applied to the input port of the comparator is regularly changed within the fixed range, so that it is possible to prevent the unstable luminance caused by the rapid current change in the lamp. To stably maintain the luminance after raising the current, the pulse having the shape similar to PWM waveform of the predetermined frequency is applied for the preset period of time, whereby the current and voltage are linearly decreased to improve the luminance-stabilization properties.

Even though the high current is forcibly applied to the surface light source to decrease the time period for the stabilization of luminance and to improve the low-temperature starting properties, the power consumption (W) can be decreased by shortening the time period of supplying the high current. In this respect, the surface light source according to the present invention may be applied to the various manufactures.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A driving circuit of a surface light source comprising:

an inverter controller which feedbacks a current supplied to the surface light source, and compares the feedback current to a preset reference value, to control the current supplied to the surface light source;

a temperature sensor which senses an operation temperature of the surface light source; and a driving-condition determining controller which determines an operation mode of the surface light source on the basis of the temperature sensed in the temperature sensor, and varies the feedback current inputted to the inverter controller according to the operation mode of the surface light source, and outputs on/off signals to control an operation time period of the inverter controller by varying a duty ratio depending on the varied feedback current.

2. The driving circuit of claim 1, wherein the operation modes include a striking mode for low temperature driving, a warm-up mode for stabilization of luminace, and a normal mode for normal state driving.

3. The driving circuit of claim 1, wherein the inverter controller includes a differential amplifier which amplifies the difference between the feedback current inputted to an inversion terminal (−) and the reference value inputted to a non-inversion terminal (+).

4. The driving circuit of claim 1, wherein the driving-condition determining controller controls operation of the surface light source in the striking mode when the temperature is in a first predetermined temperature range, the driving-condition determining controller:

controlling operation of the surface light source based on a first predetermined level of the current applied to start the surface light source, and controlling operation of the surface light source based on a second predetermined level of the current applied to the surface light source after the surface light source has started, wherein the second predetermined level of the current is lower than the first predetermined level of the current.

5. The driving circuit of claim 1, wherein driving-condition determining controller controls operation of the surface light source in the warm-up mode when the temperature is in a second predetermined temperature range, the driving-condition determining controller:

controlling operation of the surface light source in the warm-up mode for a first predetermined period of time when the temperature lies in a first portion of the second predetermined temperature range, and controlling operation of the surface light source in the warm-up mode for a second predetermined period of time when the temperature lies in a second portion of the second predetermined temperature range, wherein the first period of time is different from the second period of time.

6. The driving circuit of claim 1, wherein the driving-condition determining controller controls operation of the surface light source in the warm-up mode when the temperature is in a second predetermined temperature range, the driving-condition determining controller:

controlling operation of the surface light source based on a third predetermined level of the current applied to start the surface light source in a first portion of the second predetermined temperature range, and controlling operation of the surface light source based on a fourth predetermined level of the current applied to the surface light source in a second portion of the second predetermined temperature range, wherein the fourth predetermined level of the current is lower than the second predetermined level of the current.

7. The driving circuit of claim 1, wherein driving-condition determining controller:

outputs the on/off signal corresponding to a first duty ratio when a first predetermined level of current is supplied to the surface light source, and outputs the on/off signal corresponding to a second duty ratio when a second predetermined level of current is supplied to the surface light source, wherein the first and second duty ratios are different.

8. The driving circuit of claim 7, wherein the second duty ratio is greater than the first duty ratio if the second predetermined level of current is lower than the first predetermined level of current.

9. A driving circuit of a surface light source, comprising:

an inverter controller which feedbacks a current supplied to the surface light source and compares the feedback current to a preset reference value, to control the current supplied to the surface light source;

a temperature sensor which senses an operation temperature of the surface light source; and a driving-condition determining controller which determines an operation mode of the surface light source on the basis of the temperature sensed in the temperature sensor, varies the feedback current inputted to the inverter controller according to the operation modes of the surface light source, and outputs on/off signals to control an operation time period of the inverter controller by varying a duty ratio depending on the varied feedback current, wherein the driving circuit further comprises:

a divider which divides the feedback current, and outputs the divided current to the inverter controller; and at least two current breakers which limit a level of current divided by the divider and applied to the inverter controller under control of the driving-condition determining controller.

10. The driving circuit of claim 9, wherein the at least two current breakers include:

at least one first current breaker which is comprised of a diode and a resistor; and a second current breaker which is comprised of a diode, a resistor and a capacitor to prevent the rapid change of the feedback current.

11. The driving circuit of claim 10, wherein the respective resistors of the current breakers have different resistance values.

12. A method of driving a surface light source including an inverter controller to control a current applied to the surface light source, and a driving-condition determining controller to determine operation modes of the surface light source on the basis of an operation temperature, and to vary a current outputted to the inverter controller, comprising:

sensing the operation temperature of the surface light source;

determining an operation mode of the surface light source according to the sensed operation temperature;

varying a feedback current to the inverter controller based on the determined operation mode;

outputting on/off signals to control an operation time period of the inverter controller by varying a duty ratio depending on the varied feedback current; and outputting an output current of the inverter controller based on the feedback current.

13. A method of driving a surface light source including an inverter controller to control a current applied to the surface light source, and a driving-condition determining controller to determine operation modes of the surface light source on the basis of an operation temperature and to vary a current outputted to the inverter controller, comprising:

sensing the operation temperature of the surface light source;

determining an operation mode of the surface light source according to the sensed operation temperature;

varying a feedback current to the inverter controller based on the determined operation mode;

outputting on/off signals to control an operation time period of the inverter controller by varying a duty ratio depending on the varied feedback current, and outputting an output current of the inverter controller based on the determined operation mode, wherein determining the operation modes includes:

determining that the surface light source is in a striking mode for which a high current is applied to the surface light source, when the operation temperature of the surface light source is in a low-temperature range below a room temperature;

determining that the surface light source is in a warm-up mode for which a current, which is lower than that for the striking mode, is applied to the surface light source, when the operation temperature of the surface light source is in the room temperature range, for the stabilization of luminance; and determining that the surface light source is in a normal mode for which the surface light source is driven based on a feedback current of the surface light source, when the operation temperature of the surface light source is above the room temperature range.

14. The method of claim 13, wherein the warm-up mode is operated if the operation temperature of the surface light source is between 1° C. and 40° C., the striking mode is operated if the operation temperature of the surface light source is below 1° C., and the normal mode is operated if the operation temperature of the surface light source is above the room temperature.

15. The method of claim 13, wherein the level of the operation temperature for the warm-up mode is subdivided into the first level of 15° C.<the operation temperature≦40° C., and the second level of 1° C.≦the operation temperature≦15° C., and the first and second levels have the different processing periods of time.

16. The method of claim 13, wherein, if the operation temperature of the surface light source is below 1° C., the striking mode is firstly operated and then the warm-up mode is secondly operated.

17. The method of claim 13, wherein, if the operation temperature of the surface light source is above the room temperature, the normal mode is operated by applying a warm-up pulse for a preset period of time without operating the warm-up mode.

18. The method of claim 17, wherein the warm-up pulse is applied for 1 sec.

19. The method of claim 13, wherein the duty ratio is relatively low if the current applied to the surface light source is high to lower power consumption, and the duty ratio is relatively high if the current applied to the surface light source is low.

* * * * *

UNITED STATES PATENT AND TRADEMARK OFFICE

CERTIFICATE OF CORRECTION

PATENT NO. : 7,538,498 B2
APPLICATION NO. : 11/766909
DATED : May 26, 2009
INVENTOR(S) : Jeong Wook Hur and Hwan Woong Lee It is certified that error appears in the above-identified patent and that said Letters Patent is hereby corrected as shown below:

On the Title Pg. Item (73), change "Assignee: LG Electronics Inc." to
-- Assignees: Math Bright Technology Co., Ltd. and Lumiette Inc. --

Signed and Sealed this

Twelfth Day of January, 2010

David J. Kappos

David J. Kappos
*Director of the United States Patent and Trademark Office*